US008485102B2

(12) United States Patent
Carlson et al.

(10) Patent No.: US 8,485,102 B2
(45) Date of Patent: Jul. 16, 2013

(54) MARKING AMMUNITION

(75) Inventors: Erik K. Carlson, Oak Grove, MN (US); Lawrence P. Head, Cambridge, MN (US); Matthew S. Schroeder, Princeton, MN (US)

(73) Assignee: Alliant Techsystems, Inc., Minneapolis, MN (US)

( * ) Notice: Subject to any disclaimer, the term of this patent is extended or adjusted under 35 U.S.C. 154(b) by 94 days.

(21) Appl. No.: 13/087,187

(22) Filed: Apr. 14, 2011

(65) Prior Publication Data

US 2011/0252999 A1 Oct. 20, 2011

Related U.S. Application Data

(60) Provisional application No. 61/342,508, filed on Apr. 14, 2010.

(51) Int. Cl.
*F42B 12/36* (2006.01)

(52) U.S. Cl.
USPC ..... 102/513; 102/502; 102/367; 102/370

(58) Field of Classification Search
USPC ..... 102/366, 367, 370, 444, 498, 502, 102/512, 513; 86/31, 54
See application file for complete search history.

(56) References Cited

U.S. PATENT DOCUMENTS

| | | | | |
|---|---|---|---|---|
| 459,417 | A * | 9/1891 | McIntyre et al. | 102/366 |
| 1,417,475 | A * | 5/1922 | Weeke | 102/370 |
| 2,629,600 | A | 2/1953 | Edmonds | |
| 3,584,582 | A * | 6/1971 | Muller | 102/512 |
| 3,865,038 | A | 2/1975 | Barr | |
| 3,911,824 | A * | 10/1975 | Barr et al. | 102/502 |
| 3,983,817 | A * | 10/1976 | Tucker | 102/513 |
| 4,326,463 | A * | 4/1982 | Burke et al. | 102/513 |
| 5,354,225 | A * | 10/1994 | Hix | 446/180 |
| 5,654,524 | A * | 8/1997 | Saxby | 102/513 |
| 6,393,992 | B1 | 5/2002 | Vasel et al. | |
| 6,543,365 | B1 * | 4/2003 | Vasel et al. | 102/502 |

(Continued)

FOREIGN PATENT DOCUMENTS

| | | |
|---|---|---|
| CA | 2 294 867 | 8/2005 |
| CA | 2 594 864 | 12/2005 |

(Continued)

OTHER PUBLICATIONS

Application and file history for U.S. Appl. No. 10/846,883, filed May 14, 2004. Inventor: Rick Huffman.

(Continued)

*Primary Examiner* — Bret Hayes
*Assistant Examiner* — Joshua Freeman
(74) *Attorney, Agent, or Firm* — Christensen Fonder P.A.

(57) ABSTRACT

Marking cartridge for conventional firearms that deposits marking media on impact with a target. The marking cartridge generally comprises a marking projectile containing a quantity of marking media beneath a frangible cap portion and having a more durable exterior surface adapted to engage the rifling of the barrel when fired. The marking projectile also may comprise a receptacle for marking media having a curled lip adapted to remove air during assembly and excess marking media to insure a consistent quantity of marking media is contained within the marking projectile. The receptacle defining a marking media cavity radially spaced from exterior bearing portion wall and having a mushroom shape. The marking cartridge also may comprise an extendable casing.

24 Claims, 11 Drawing Sheets

U.S. PATENT DOCUMENTS

| | | | | |
|---|---|---|---|---|
| 6,619,211 | B1 * | 9/2003 | Haeselich | 102/513 |
| 6,807,908 | B2 * | 10/2004 | Brydges-Price | 102/512 |
| 7,086,337 | B2 * | 8/2006 | Klein | 102/502 |
| 7,121,211 | B2 | 10/2006 | Beal | |
| 7,143,699 | B2 | 12/2006 | Brock et al. | |
| 7,225,741 | B2 | 6/2007 | Huffman | |
| 7,278,358 | B2 | 10/2007 | Huffman | |
| 7,287,475 | B2 | 10/2007 | Brunn | |
| 7,475,638 | B2 * | 1/2009 | Haeselich | 102/513 |
| 7,487,728 | B2 * | 2/2009 | Cranor | 102/513 |
| 7,621,208 | B2 | 11/2009 | Huffman | |
| 7,819,065 | B2 * | 10/2010 | Haeselich | 102/444 |
| 7,913,626 | B1 * | 3/2011 | Reinhardt et al. | 102/517 |
| 7,984,668 | B2 | 7/2011 | Huffman | |
| 8,065,962 | B2 * | 11/2011 | Haeselich | 102/513 |
| 8,297,187 | B2 * | 10/2012 | Sullivan | 102/213 |
| 2004/0089186 | A1 * | 5/2004 | Brygdes-Price | 102/502 |
| 2005/0066841 | A1 | 3/2005 | Vasel et al. | |
| 2005/0066849 | A1 | 3/2005 | Kapeles et al. | |
| 2005/0229807 | A1 * | 10/2005 | Brock et al. | 102/502 |
| 2006/0032393 | A1 * | 2/2006 | Haeselich | 102/502 |
| 2006/0048668 | A1 | 3/2006 | Williams | |
| 2007/0089627 | A1 * | 4/2007 | Brock et al. | 102/513 |
| 2007/0119329 | A1 * | 5/2007 | Haeselich | 102/498 |
| 2007/0151473 | A1 * | 7/2007 | Brunn | 102/444 |
| 2007/0289475 | A1 * | 12/2007 | Kapeles | 102/502 |
| 2008/0053330 | A1 | 3/2008 | Haeselich | |
| 2008/0178728 | A1 | 7/2008 | Kapeles et al. | |
| 2008/0178758 | A1 * | 7/2008 | Kapeles et al. | 102/502 |
| 2009/0101038 | A1 * | 4/2009 | Kapeles et al. | 102/502 |
| 2010/0263568 | A1 * | 10/2010 | Huffman | 102/502 |
| 2010/0269724 | A1 * | 10/2010 | Head et al. | 102/447 |
| 2011/0023744 | A1 * | 2/2011 | Endicott et al. | 102/502 |
| 2011/0079164 | A1 * | 4/2011 | Broden et al. | 102/444 |
| 2011/0252999 | A1 * | 10/2011 | Carlson et al. | 102/513 |

FOREIGN PATENT DOCUMENTS

| | | | |
|---|---|---|---|
| EP | 1 962 048 | A2 | 8/2008 |
| FR | 2 323 981 | A1 | 4/1977 |
| WO | WO 2005/076787 | A2 | 8/2005 |
| WO | WO 2005/119165 | A2 | 12/2005 |

OTHER PUBLICATIONS

Application and file history for U.S. Appl. No. 11/852,181, filed Sep. 7, 2007. Inventor: Rick Huffman.

Application and file history for U.S. Appl. No. 10/799,898, filed Mar. 12, 2004. Inventor: Rick Huffman.

Application and file history for U.S. Appl. No. 11/616,843, filed Dec. 27, 2006. Inventor: Rick Huffman.

Application and file history for U.S. Appl. No. 12/625,033, filed Nov. 24, 2009. Inventor: Rick Huffman.

* cited by examiner

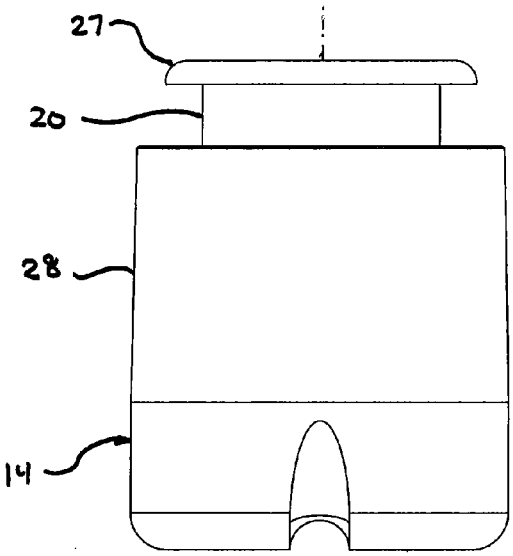
Figure 9B
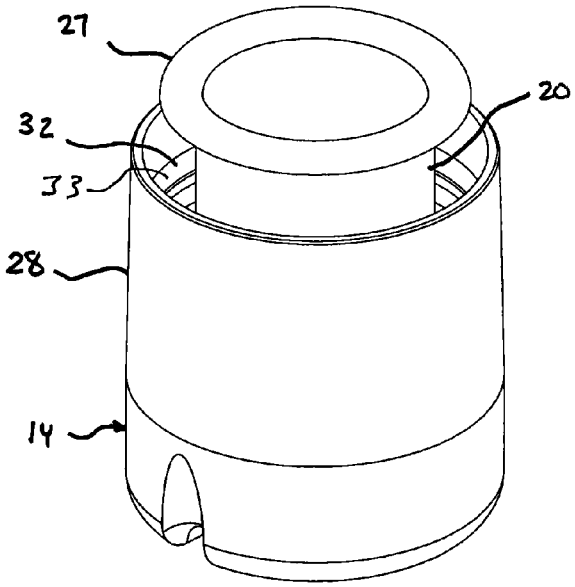
Figure 9A
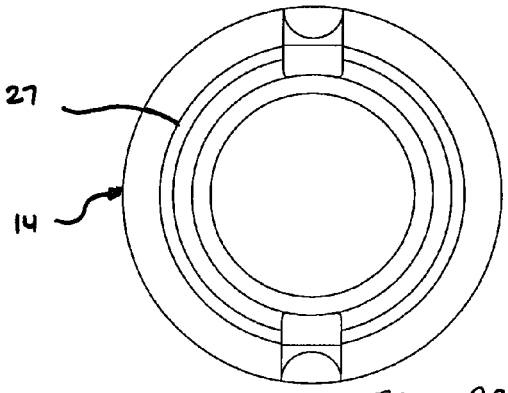
Figure 9C
FIGURE 9

MARKING AMMUNITION

PRIORITY CLAIM

This application claims priority to U.S. Provisional Application No. 61/342,508 filed on Apr. 14, 2010, the contents of which are incorporated by reference herein in their entirety.

BACKGROUND OF THE DISCLOSURE

Marking cartridges are designed to propel a non-lethal marking projectile to a target and deposit a visual indicator at the impact point of the projectile. Typically, the marking projectile is mounted to a specialized cartridge casing which launches the marking projectile at a non-lethal velocity to the target. Currently, many of the specialized cartridge casings attempt to mimic cartridge casings used for conventional ammunition such that the marking cartridge can be fired from conventional firearms with minimal or no modifications to the firearm.

The marking media deposited on impact typically comprises colored powder, liquid, paste or gel. The marking media is often encased in a frangible shell that fractures on impact which reduces the impact force of the projectile and releases the marking material. While the frangible shell needs to effectively convey the marking media to the impact point, it also needs to survive the mechanical engagements associated with cartridge handling and loading in conventional firearms. The frangible shell can become cracked or shatter during the loading process depositing the marking media and/or shell material within the firearm or otherwise rendering the marking projectile unsuitable for firing. During firing, the frangible shell is brittle and may not optimally engage the rifling of the barrel or may be damaged by such engagement. With less than optimal engagement of the rifling, a marking projectile cannot properly simulate a conventional projectile, which is rotated rapidly along its axial axis by the rifling to increase the accuracy of the bullet. The lightweight materials commonly used in marking projectiles exacerbate the problem by increasing the effect of environmental factors, for example wind, on the flight path of the marking projectile. A lack of adequate axial rotation and the light weight of the projectile can result in a dramatic decrease in accuracy.

Moreover, the marking media itself may decrease the accuracy or otherwise impact the flight of the marking projectile. As the marking media typically comprises liquids or powder, any inconsistencies in the packing of the marking media, such as air bubbles or an uneven distribution of marking media, can cause the marking media to shift during flight preventing the projectile from flying straight or cause the projectile to cork screw in flight. The discrete size of the marking projectile makes evenly and precisely loading the marking media into the marking projectile more difficult, which increases the likelihood that there will be manufacturing inconsistencies and quality control issues. A marking projectile is needed that provides more optimal engagement of the barrel rifling, has improved accuracy, has suitable strength for firing, and is suitably frangible on impact.

Furthermore, maintaining the non-solid marking material within the projectile can be difficult when the projectile is subjected to varying ambient conditions during long storage periods. Paste and liquid marking fluids are known to leak from stored conventional marking cartridges which can render the cartridges useless or present a hazard and other difficulties when the cartridge is attempted to be used in a firearm. A marking projectile is needed with greater marking fluid containment integrity and greater uniformity in the packing of the marking fluid in the projectile.

The relative weight difference between marking projectiles and conventional cartridges can also impact operation of the firearm. As marking projectiles are typically substantially lower in weight than conventional bullets, less propellant is required to propel a marking projectile as compared to a conventional bullet. The reduced propellant load also reduces the blowback of the casing when the marking projectile is fired. The reduced blowback may be insufficient to operate the ejector mechanism of a conventional firearm and eject the spent casing from the firearm. The inability of marking projectiles to properly operate the ejection and reloading mechanisms of conventional firearms may force users to manually chamber a new round after each marking projectile is fired and prevent marking projectiles from being effectively used in automatic and semi-automatic firearms. Marking cartridges are needed that provides the desirable attributes above and which may reliably be used in conventional firearms.

SUMMARY OF THE DISCLOSURE

The present invention is directed to marking cartridges that are usable with conventional firearms for depositing a quantity of marking media at the point of impact. Marking ammunition according to the present invention, can generally comprise a marking projectile and a marking projectile in association with an expandable cartridge casing. The marking projectile is adapted to receive and seal a quantity of marking media within an at least partially frangible containment until the marking media is released by impact with a target. The expandable cartridge casing is adapted to propel the marking projectile at a non-lethal velocity to the target, while still being accommodated by the loading mechanisms of conventional firearms and capable of effectively operating the mechanical components of the ejector system of such conventional firearm.

In an embodiment, a marking cartridge has a projectile with plurality of seals for maintaining the integrity of the marking fluid therein. and has an annular cavity surrounding the cavity with the marking material. In an embodiment, the cavity containing the marking fluid has a frusto dome shape portion adjacent an ogive wall portion of the projectile and a columnar portion extending below same.

The marking projectile, according to the present invention, can comprise a frangible cap portion latched to a projectile body portion. The frangible cap portion comprises a hollow projectile tip portion and a skirt portion, configured as a cylindrical wall, extending from the projectile tip portion. The projectile body portion comprises an inner post defining a receptacle and insertable into the cavity defined by the projectile tip portion and the skirt portion. The receptacle can cooperate with the projectile tip portion of the frangible cap portion to define a primary enclosed space for receiving a quantity of marking media beneath the projectile tip portion. A skirt portion of the frangible tip portion can engage the base of the inner post to define a secondary enclosed space defined around the inner post for receiving any excess marking material that may have escaped from the primary enclosed space. The secondary enclosed space may also provide a crumple zone for allowing the inner post to collapse and crumple on impact with the target reducing the force with which the projectile hits the target and discharging the marking media at the point of impact. The edges of the receptacle are adapted to engage the interior of the projectile tip portion such that the first and second enclosed spaces are isolated once the marking projectile is assembled.

The receptacle of the projectile body portion can further comprise a curled lip for engaging the projectile tip portion such that air and/or excess marking media is forced out of the primary enclosed space into the secondary enclosed space as the frangible cap portion is fitted to the projectile body portion. The primary enclosed space contains the primary quantity of marking fluid, which comprises a substantial amount of the mass of the projectile. As a result, inconsistencies in the primary quantity of marking fluid, such as air bubbles, can cause an irregular flight pattern in the projectile. Similarly, the inconsistencies could also prevent the frangible cap portion from effectively fracturing upon impact or cause the frangible cap portion to fracture prematurely before impacting the target. The curled lip eliminates a number of the inconsistencies in the marking fluid that can occur during the manufacturing.

The projectile body portion can further comprise a sleeve portion extending from the base of the projectile body portion corresponding to the skirt portion of the frangible cap portion. The cylindrical wall portion of the projectile body portion is adapted to overlap the skirt portion of the frangible tip portion such that only the projectile tip portion is exposed when the frangible cap portion is fitted to projectile body portion. The cylindrical wall portion of the projectile body portion protects the sides of the frangible cap portion to prevent fracturing as the marking projectile is fired from the firearm. Furthermore, the skirt portions of the frangible cap portion and projectile body portion can be sealingly engaged to hermetically seal the primary and secondary enclosed spaces and any marking media contained within the spaces. The hermetic seal can significantly improve the shelf life of the cartridge due to the high integrity containment of the marking media.

The skirt portion of the frangible cap portion and the skirt portion of the projectile body portion can each comprise corresponding engagement features for engaging the frangible cap portion to the projectile body portion to the frangible cap portion. The corresponding engagement features are oriented to interlock as soon as the frangible cap portion and projectile body portion are joined to prevent separation of the projectile body portion and frangible cap portion. The engagement features also maintain the hermetic seal between the frangible cap portion and projectile body portion.

The marking projectile can comprise a two material design combining a frangible cap portion that is easily fractured upon impact with the target to release the marking material and a durable projectile body portion for preventing accidental fracturing of the frangible cap portion during loading and firing of the projectile. The frangible can comprise rigid plastic material, such as polystyrene or any other suitable rigid polymer. Correspondingly, the projectile body portion can comprise a lightweight, durable plastic material, such as polyethylene, that can withstand being actuated by the mechanical components of the firearm. The durable plastic material also allows the portion of the projectile body portion to engage the rifling of the firearm during firing. As such, the firearm can impart a spin to the marking projectile comparable to the spin imparted to conventional projectiles fired from the same firearm. The spin imparted to the marking projectile improves the range of the marking projectile as well as providing flight characteristics comparable to those of conventional projectiles.

The cartridge casing can further comprise a sleeve defining an interior space for receiving and retaining a portion of the marking projectile and a quantity of propellant. The casing can also comprise a rim adapted to engage the ejection and reloading mechanisms of conventional firearms. The casing can further comprise a telescoping slide adapted to extend the rim backwards such that rim engages the ejection and reloading mechanism of an automatic or semi-automatic firearm. The slide is adapted compensate for the reduced casing blowback associated with the reduced propellant necessary for the lighter marking projectile by sliding the rim sufficiently far back to engage the reloading mechanisms.

The rim can further comprise a shoulder for engaging the edge of the sleeve when the telescoping slide is full retracted within the sleeve.

The sleeve can define a reduced thickness portion proximate the end opposite to the marking projectile. The sleeve is crimped inward at the reduced thickness portion to a non-perpendicular angle to remainder of the sleeve such that the sleeve engages the telescoping portion when the telescoping portion is fully extended to prevent the telescoping portion from separating from the sleeve. The reduced thickness portion also engages the telescoping portion to prevent the telescoping portion from retracting into the sleeve during the extraction and ejection of the cartridge casing.

A feature and advantage of particular embodiments of the invention is that cartridges may be fired from a conventional firearm as if ordinary cartridges without modification to loading and ejection mechanisms of the firearm.

A feature and advantage of particular embodiments is that the marking media as contained in the marking projectile is mushroom shaped, due to the mushroom shaped cavity, having a cap portion and a base portion. The mushroom shape is believed to provide better dispersal of the marking media on impact in that the trailing column of fluid is believed to force the fluid out after the tip fracture for a period of time that exceeds that in a conventional marking projectile with a similar volumetric quantity of marking fluid and having the conventional bullet shape cavity. This sustained release is believed to provide a better dispersal of the marking media on the target.

A feature and advantage of embodiments of the invention is that plurality of sealing junctures that are radially separated secure the marking media within the marking projectile. In embodiments the plurality of sealing junctures are also axially separated. The first sealing juncture is provided a flared and rolled tubular end portion that engages inside surface of the domed cap portion. The second sealing juncture is provided by the latching connection between the skirt of the cap portion and the cylindrical wall of base portion.

A feature and advantage of particular embodiments is that the bearing portion of the marking projectile comprises a cylindrical wall that engages the rifling has a composite construction with a double wall extending axially for a substantial portion of the bearing surface. In an embodiment the bearing wall has an exterior wall formed of a polymer softer that the interior wall polymer. In an embodiment the bearing wall has an interior wall formed of a polymer with more rigidity or stiffness than the exterior wall polymer. In an embodiment, the bearing wall has an interior wall formed of a polymer with less creep capacity at room temperatures than the exterior wall polymer. In an embodiment of the invention the exterior or outer wall overlaps radially the interior or inner wall for an axial length of at least half of the axial length of the bearing portion length of the marking projectile with each of the walls being cylindrical walls, that is, a wall with at least one generally cylindrical surface. In an embodiment of the invention the exterior wall overlaps radially the interior wall for an axial length of at least 70% of the axial length of the bearing surface of the marking projectile with each of the walls being cylindrical walls. In an embodiment of the invention the exterior wall overlaps radially the interior wall for an axial length of at least 80% of the axial length of the bearing surface of the marking projectile with each of the walls being cylindrical walls. In an embodiment of the invention the exterior wall overlaps radially the inner wall for an axial length of at least 90% of the axial length of the bearing surface of the marking projectile with each of the walls being cylindrical walls. A feature and advantage of embodiments of the invention is that said interior and exterior walls have an interference fit with one another. A feature and advantage of embodiments of the invention is that the interior and exterior walls have tapered lead-in surfaces and locking corners and provide a seal with a tortuous path for air, moisture, and marking media.

A feature and advantage is that the marking media in the first cavity is not in engagement with the exterior wall of the bearing portion. With the marking media separated from the juncture, stress and damage incurred by the bearing portion due to engagement with the rifling will not as likely lead to marking media leakage during firing. Moreover, in embodiments, the marking media is separated from the juncture between the two portions of the marking projectile that extends from the interior of the projectile to the exterior of the projectile. Similarly, this minimizes the incidents of leakage of the marking fluid to the exterior of the projectile.

A feature and advantage of particular embodiments of the invention is that a marking projectile is formed from two polymer components with marking media contained in a first cavity defined by the two polymer components, the polymer components meeting at a junction that is exposed on the exterior surface of the projectile, the juncture extending into the interior of the projectile into a second cavity. In embodiments, the first cavity extends axially and is centrally located. In embodiments, the second cavity is an annular cavity extending circumferentially and entirely around at least part of the first cavity.

A feature and advantage of particular embodiments of the invention is that a defined volume of air may be contained within the marking projectile, reducing its mass and providing a region where the structure and marking media of the marking projectile may collapse or disperse providing an enhanced shock absorption capability and thus increasing the safety of the projectile and cartridge.

A feature and advantage of particular embodiments is that the receptacle or cup of the marking projectile that contains the marking media has a tubular end portion defining a radially outwardly curled upper lip, the edge portion may extend below a line normal to the axis of the projectile. The curled upper lip portion may provide several advantageous functions. It may facilitate assembly of the base portion of the marking projectile into the cap portion, providing a guide-in feature. That is, if the axis of the cap portion and the axis of the base portion are slightly misaligned during assembly, the outer facing portion of the curl provides an alignment function. This can be particularly advantageous in the assembly of the very small component parts associated with marking cartridges. Additionally, the curled lip during assembly may be utilized to provide a separation of the paste marking media form from making contact with the cylindrical wall of the cap portion during assembly maintaining the integrity of the paste or gel form in the receptacle. Moreover the curled lip provides an effective vent for air escape during assembly of the cap portion and base portion. As these two components are being assembled, the curled lip engages the inside cylindrical surface of the skirt of the cap portion reducing the interior volume defined by these two components. As the volume is reduced the displaced air may readily escape past the curled lip-wall surface engagement. Moreover, the curled lip substantially inhibits the marking material paste or gel from escaping past the curled lip-cylindrical wall seal. Moreover, the curled lip and wall portions of the receptacle minimizes the impact shock on the target by the cylindrical block portion of the base; the cylindrical block portion of the base is where most of the polymer mass of the projectile is located, thus providing a further safety feature. Additionally, on impact, the media form is axially directly in front of the cylindrical block portion of the post, this allows the inertial energy of the cylindrical block portion to be dissipated by the compression and dispersion of the marking media on impact.

Additionally the curled lip provides that the marking fluid form in the marking projectile may extend radially outward from the confines of the receptacle and engage the cylindrical wall portion of the cap portion. This allows the displaced air in the chamber defined by the cap portion and body portion as it is being reduced in volume as the two components are being assembled to escape.

A feature and advantage of embodiments of the invention is that the body portion material is softer than the cap portion material. Polymer softness correlates to less frangibility and more resiliency. In that the body portion does not need to fracture on impact to disperse the marking fluid, providing a material in the body portion that is softer than the material in the cap portion allows more effective gripping of the projectile by the rifling in the barrel of the firearm. Moreover, utilizing a softer polymer for one of the two cooperating components provides a seal of higher integrity between the respective wall portions.

A feature and advantage of an embodiment of the invention is that the material of the body portion is more resilient that the cap portion material. A feature and advantage of an embodiment of the invention is that the material of the body portion is less frangible that the cap portion material.

A feature and advantage of embodiments of the invention is a marking projectile with a central axially extending cavity substantially filled or filled with marking media and an annular concentric cavity extending around the central cavity, the annular concentric cavity substantially void of marking media. Additionally, the marking fluid may extend to the apex region of an ogive portion and then extend radially outward of the projectile. Such provides a more optimal positioning of the marking media for the purpose of improved flight trajectory when there is a void in the marking media. That is a void displaced farther from the axis causes a greater shift in the projectiles center of gravity. With the marking media positioned closer to the axis, voids will have less shift of the center of gravity and less effect on the trajectory.

A feature and advantage of embodiments of the invention is a marking projectile with a columnar portion of marking media extending axially in the projectile and an annular concentric cavity extending around the central cavity, the annular concentric cavity substantially void of marking media. The columnar portion may provide an inertial hydraulic discharge of the marking media on impact which is believed to provide a wider dispersement and thus a more visible mark on impact.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE FIGURES

The invention can be completely understood in consideration of the following detailed description of various embodiments of the invention in connection with the accompanying drawings, in which:

FIG. 9A is a perspective view of a projectile body portion according to an embodiment of the present invention.

FIG. 9B is a side view of the projectile body portion depicted in FIG. 9A.

FIG. 9C is a bottom view of the projectile body depicted in FIGS. 9A and 9B.

Figure 1:
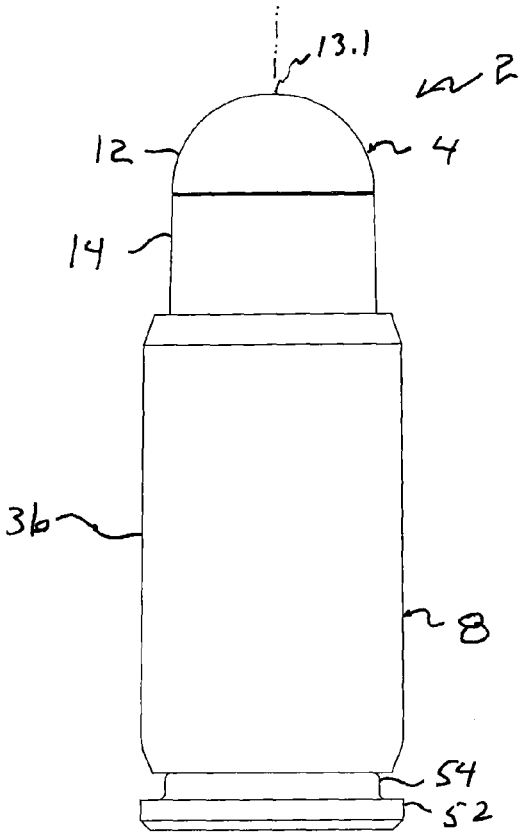
FIG. 1 is a side view of a round of marking cartridge according to an embodiment of the present invention.
Figure 2:
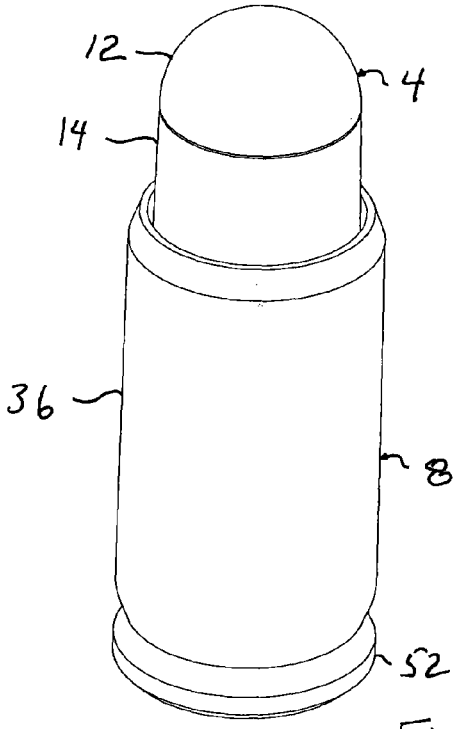
FIG. 2 is a perspective view of the marking cartridge depicted in FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE FIGURES

Referring to FIGS. 1-3 and 6-7, a marking cartridge 2, according to an embodiment of the present invention, generally comprises a marking projectile 4 containing a quantity of marking media 6 and a cartridge casing 8 containing a quantity of propellant 10, contained in a primer 11, for propelling the marking projectile 4 to a target. As depicted, the marking cartridge 2 may be proportioned and sized as 9 mm pistol cartridge, but can be shaped and sized to conform to other sizes of conventional cartridge. The marking media 6 may comprise a gel or paste in certain embodiments. In other embodiments the marking media can be liquid or powder.

Referring in particular to FIGS. 3, 6-7, and 8A-10C, the marking projectile 4 in an embodiment comprises a frangible cap portion 12 and a projectile body portion 14. The components each have an axis, indicated by the dot-dash lines, that when assembled into the projectile are coincident with each other and further coincident with the axis of the projectile, indicated by a double dot dash. The projectile has an ogive portion 13, with an apex 13.1, a bearing portion 17, and a heel or tail portion 19.

The frangible cap portion 12 separately includes the ogive portion 13 with an ogive wall portion 15, projectile tip portion 16 and a skirt portion 18 configured as a cylindrical wall extending from the projectile tip portion 16. The frangible cap portion 12, particularly at the ogive portion, utilizes a polymer selected to facilitate fracture upon impact with a target. Such polymers may include, but are not limited to, polystyrene. In embodiments the polymer may be transparent or translucent allowing viewing of the marking media immediately there below. Integral ribs 21 may be provided on the inside surface of the tip portion providing enhanced strength to the cap portion to minimize unintended fracture during assembly, handling or firing. With the thinner regions 21.2 intermediate the ribs being maintained, the fracturing capability on impact with a target is not diminished by the presence of the ribs.

The projectile body portion 14 further comprises an inner post 20 defining a cup or receptacle 22 for receiving the quantity of marking media 6. The receptacle 22 having a cylindrical wall 23 that defines the first cavity and has a columnar portion 23.3 that thus provides a columnar portion of the marking media when same is deposited therein. The projectile body portion 14 can comprise a resilient polymer adapted to withstand the mechanical loading of the marking cartridge 2 by the firearm, including but not limited to, polyethylene.

The marking projectile 4 may be assembled by inserting the inner post 20 into frangible cap portion 12 such that the receptacle engages the frangible cap portion 12 defining a first cavity or a primary enclosed space 24 for receiving the marking media 6. Correspondingly, the skirt portion 18 of the frangible cap portion 12 engages the projectile body portion 14 when the inner post 20 is inserted into the frangible cap portion 12 so as to define a second cavity or secondary enclosed space 26 positioned annularly around inner post 20.

In an embodiment, during manufacturing, the quantity of marking media 6 is deposited within the receptacle 22 before the inner post 20 is inserted into the frangible cap portion 12 such that the marking media 6 is positioned within the first cavity or primary enclosed space 24 beneath the projectile tip portion 16 when assembled. When the projectile tip portion 16 impacts the target and fractures, the marking media 6 is released and deposited on the target. According to an embodiment of the present invention, the receptacle 22 can comprise a flared or curled lip 27. When the inner post 20 is inserted into the frangible cap portion 12, the curled lip 27 allows any air and any excess marking media 6 to escape from the primary enclosed space 22 into the secondary enclosed space 24 to ensure a consistent quantity of marking media 6 and minimal or no air within the primary enclosed space 22.

According to an embodiment of the present invention, the projectile body portion 14 can further comprise a cylindrical wall portion 28 corresponding to the skirt portion 18 of the frangible cap portion 12. The cylindrical wall portion 28 of the projectile body portion 14 is positioned to extend over the skirt portion 18 of the frangible cap portion 12 when the inner post 20 is inserted into the frangible cap portion 12. The exterior of the cylindrical wall portion 28 defines the maximum outer diameter of the marking projectile 4 and is engagable by the rifling of the firearm to impart a spin along the axial axis of the projectile 4 during firing. According to an embodiment of the present invention, the skirt portion 28 of the projectile body portion 14 can sealingly engage the skirt portion 18 of frangible cap portion 12 to hermetically seal the primary enclosed space 24 and the secondary enclosed space 26.

Figure 3:
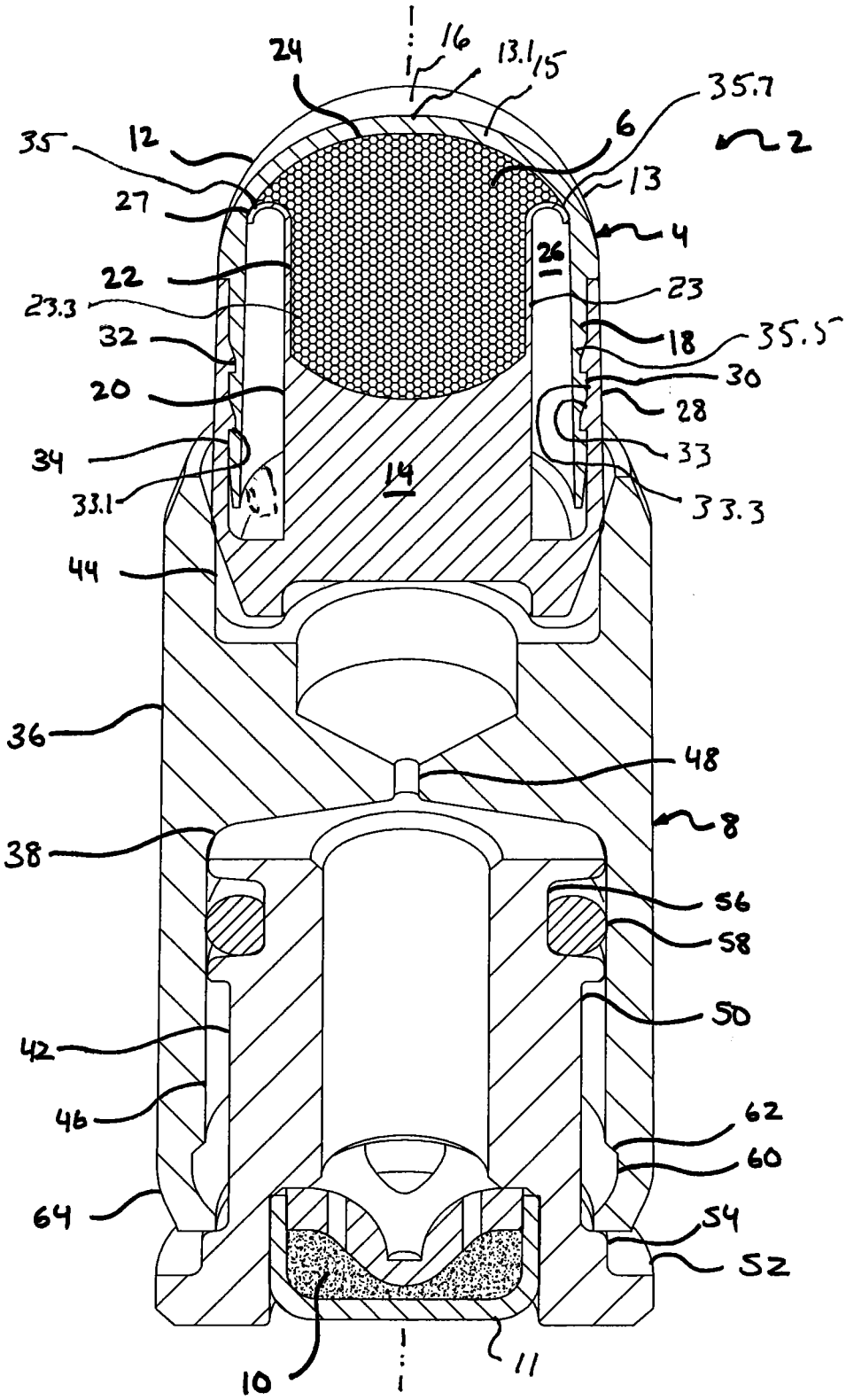
FIG. 3 is a cross-sectional perspective view of a round of marking cartridge according to an embodiment of the present invention.
Figure 4:
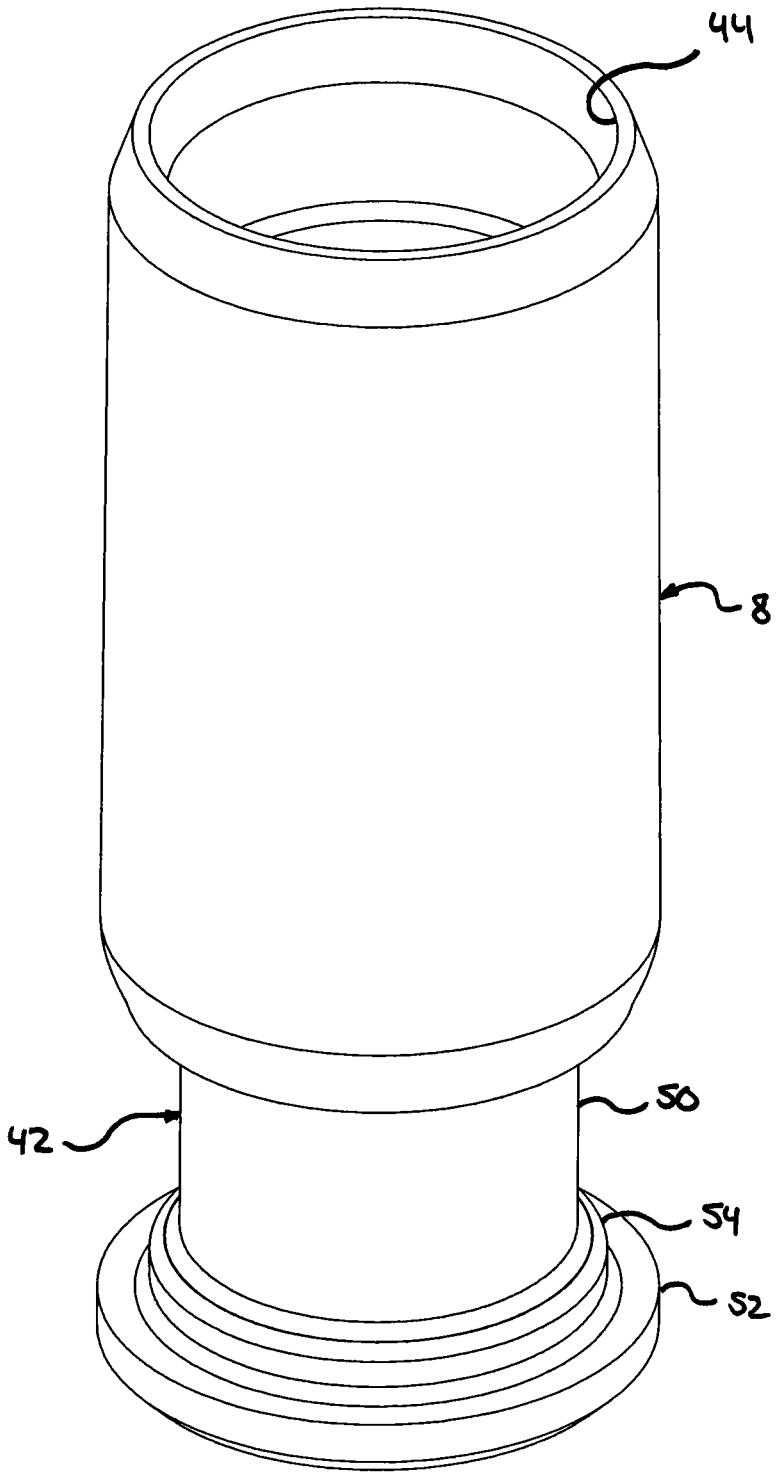
FIG. 4 is a perspective view of a cartridge casing according to an embodiment of the present invention in which the telescoping slide is fully extended.

According to an embodiment of the present invention, the skirt portion 18 of the frangible cap portion 12 can further comprise at least one engagement feature 30. Such engagement features can comprise circumferentially extending tapered surfaces 31 and circumferentially extending catch corners 31.1, and circumferentially extending grooves 31.3. Correspondingly, the cylindrical wall portion 28 of the projectile body portion 14 can also further comprise at least one engagement feature 32 that cooperates with the engagement feature 30 of the frangible cap portion 12. The engagement features of the wall portion of the body portion also may have tapered surfaces 33 and catch corners 33.1 and grooves 33.3, all configures to cooperate with the features of the wall portion of the cap portion such that as the components are slidingly engaged in an axial direction, the features latch and lock and seal the components together. The cooperating interlocking engagement features 30, 32 are oriented to interlock when the inner post 20 is inserted into the frangible cap portion 12 so as to engage the frangible cap portion 12 to the projectile body portion 14 at a seating positioned such as shown in FIG. 3. The engagement features can also comprise other conventional structure for engaging the frangible cap portion 12 to the projectile body portion 14. For example, in other embodiments the components may be joined by threads, or adhesives, or may be welded together.

According to an embodiment of the present invention, the engagement features 30, 32 also maintains the seal between cylindrical wall portion 18 of the frangible cap portion 12 and the cylindrical wall 28 of the projectile body portion 14. The respective wall portions may be sized to have an interference fit to provide a tight engagement and further facilitate a hermetic seal.

Notably the engagement of the post 20, more specifically the flared or curled lip 27, with the inside surface of the cap portion 12 provides the first or primary seal 35 for maintaining the marking media in the projectile. The sealing interlock of the respective wall portions provides a second or supplemental seal 35.5 for maintaining the marking media in the projectile. The dual seal arrangements in embodiments also prevents or minimizes the drying out or other degradation of the marking material. Significantly the seals are axially and radially separated. Moreover the primary seal juncture 35.7 leads from the first cavity 22 to the second cavity 24. Junctures typically define a leak path. The secondary seal juncture extends from the second cavity 24 to the exterior of the projectile and has a very tortuous path. The tortuous path of the secondary seal juncture, in an embodiment, has at least four change of directions or corners. In another embodiment, at least six change of directions or corners. Such a tortuous path on the secondary seal makes it difficult for the marking media, moisture, or air to pass through the juncture.

Figure 10A:
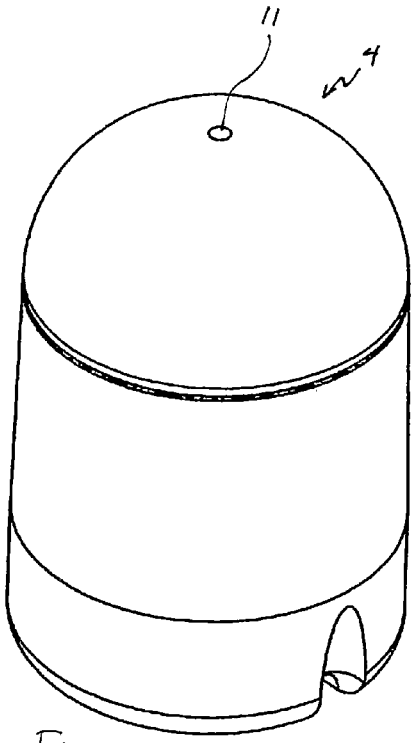
FIG. 10A is a downward perspective view of the top and side of a projectile according to an embodiment of the present invention. The downward perspective view from the opposite side being identical thereto.
Figure 10C:
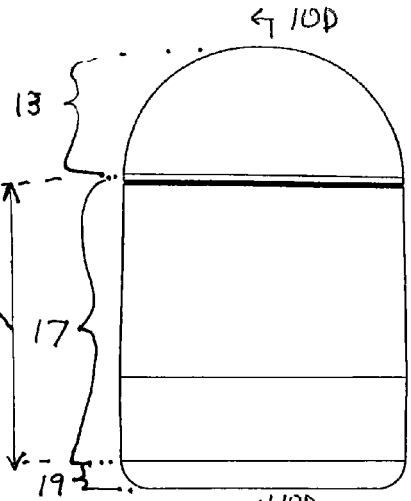
FIG. 10C is an elevational view of the projectile of FIG. 10A.
Figure 10B:
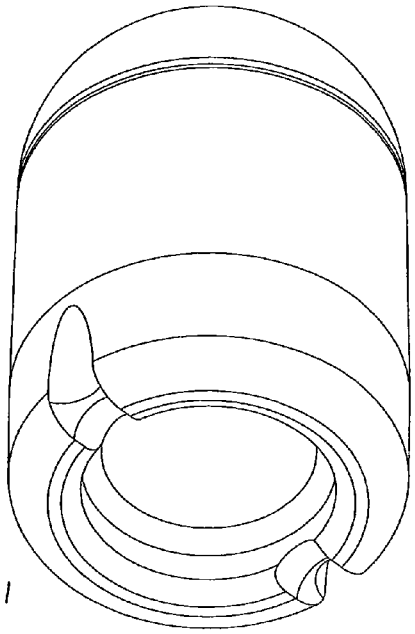
FIG. 10B is an upward perspective view of the bottom and side of the projectile of FIG. 10A. The upward perspective view from the opposite side being identical thereto.
Figure 10D:
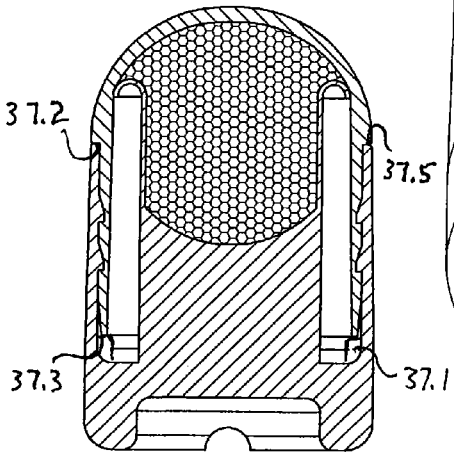
FIG. 10D is a cross sectional elevational view of the projectile of FIG. 10A taken at line 10D-10D.

The overlapping wall portions at the bearing portion extend a substation portion of the length L, see FIG. 10*c*, of the bearing portion. The structure that provides the tortuous path also provides strength to the bearing portion that engage the firearm rifling portion. The distance the overlap extends may be greater than 40% in some embodiments, or greater than 50% in some embodiments, or greater than 70% in other embodiments, or greater than 80% of the length L in other embodiments.

Figure 6:
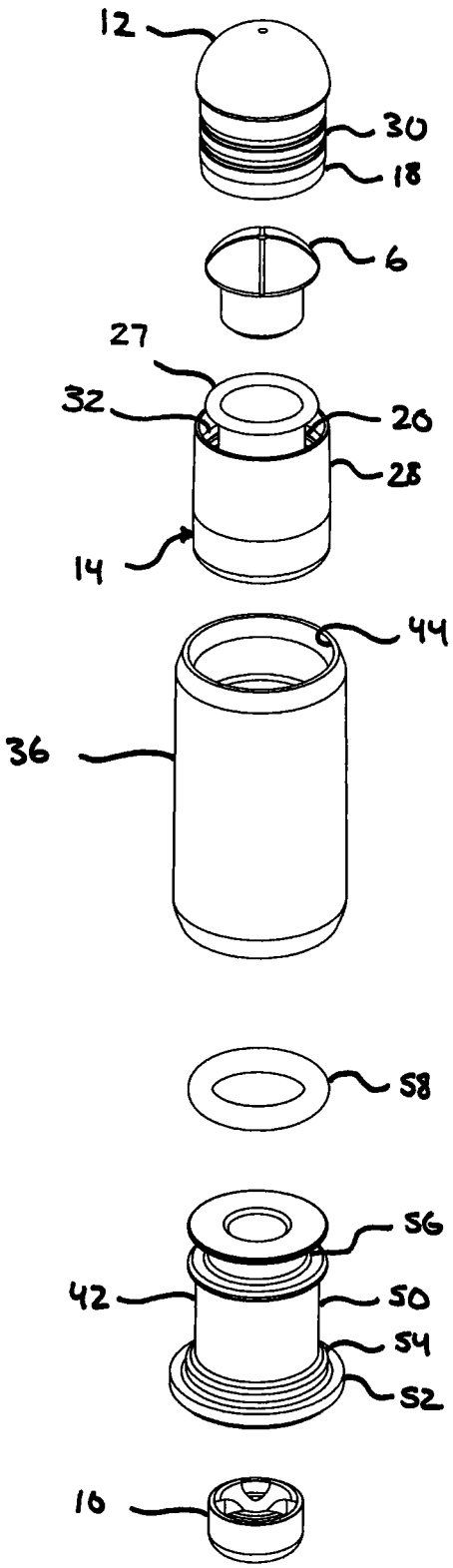
FIG. 6 is an exploded view of a round of marking cartridge according to an embodiment of the present invention.
Figure 7:
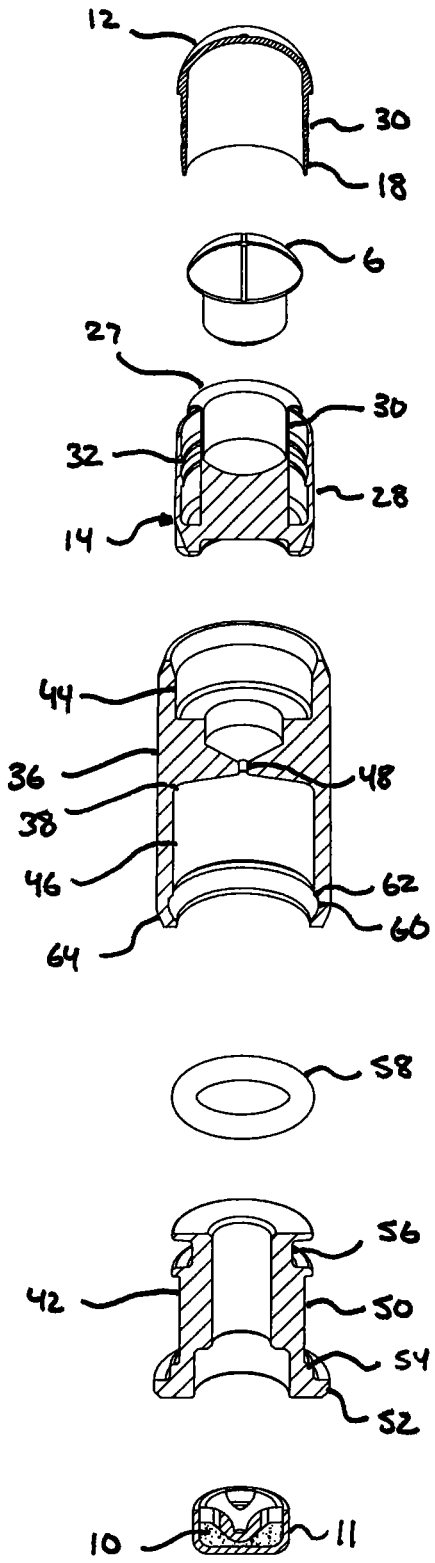
FIG. 7 is an exploded cross-sectional view of a round of marking cartridge depicted in FIG. 6.
Figure 8B:
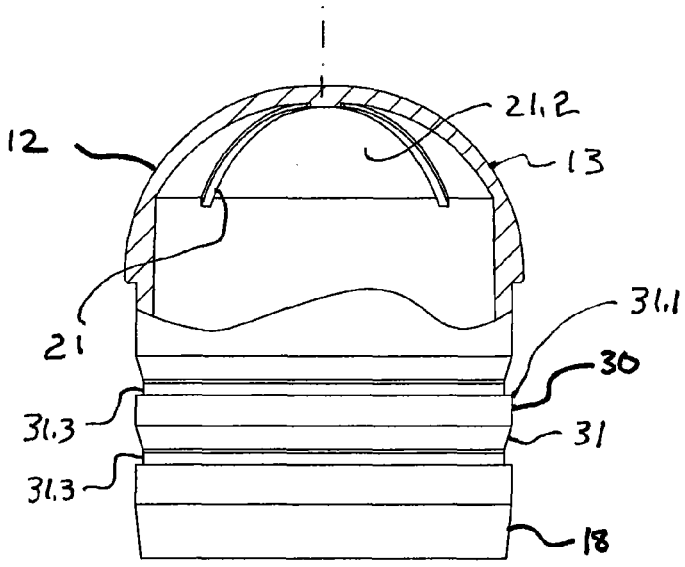
FIG. 8B is bottom view of a cap portion according to an embodiment of the present invention.
Figure 8A:
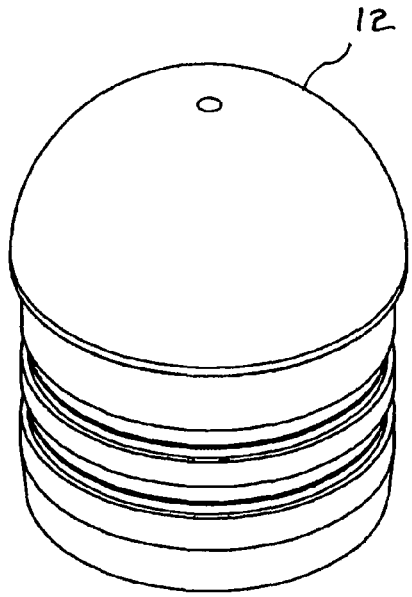
FIG. 8A is perspective view of a cap portion according to an embodiment of the present invention.
Figure 8C:
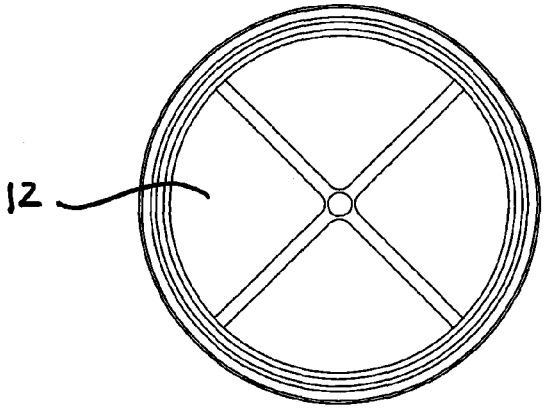
FIG. 8C is a partial cross-sectional view of the cap portion depicted in FIGS. 8A and 8B.

In embodiments, the primary seal has a less tortuous path, a simple annular lip to a concave dome surface. Particularly in embodiments where the marking media is a paste, this seal provides an adequate barrier for maintaining the shape of the marking media form and minimizing any significant leakage. The primary seal also functions during the assembly of the cap portion to the base portion to provide the final shape or form of the marking media as discussed in detail below. The final form in the embodiments as illustrated in FIGS. 3, 6, and 7 is mushroom shaped. That is the final form has a frusto dome shaped head portion and a unitary columnar shaped tail portion.

In addition to the interlocking features described above, associated with the respective wall portions of the cap portion and the base portion, stops may be utilized to prevent sliding disengagement of the respective wall portions on impact. Stops configured as tabs 37.1 or a shoulder may be positioned at the lower base of the annular recess to provide a stop for the distal edge 37.3 of the cylindrical wall portion of the cap portion. A stop configured as shoulder 37.2 can be formed on the exterior surface of the cylindrical wall portion of the cap portion to receive the distal edge 37.5 of the cylindrical wall portion of the base portion. The prevention of reduction of the sliding disengagement facilitates the breakage of the frangible ogive on impact.

According to an embodiment of the present invention, the skirt portion 18 of the frangible cap portion 12 can further comprise at least one rib 34 extending radially around the skirt portion 18 of the frangible cap portion 12. The rib 34 provides structural stability for frangible cap portion 12 during loading and firing of cartridge with the marking projectile 4 to prevent accidental fracturing of the frangible cap portion 12, while allowing the frangible cap portion 12 to break normally upon impact with the target.

According to an embodiment of the present invention, the projectile tip portion 16 can be scored such that the projectile tip portion 16 more easily fractures upon impact with the target to reduce the force imparted by the marking projectile 4 upon impact. Correspondingly, the inner post 20 may be adapted to crumple upon impact with the target into the secondary enclosed space 26 to slow the marking projectile 4 and further reduce the force with which the marking projectile 4 impacts the target. In other embodiments, the inner post may be adapted to pedal, or otherwise fracture upon impact, such as with score lines.

According to an embodiment of the present invention, the projectile tip portion 16 can comprise a transparent material showing the color of the marking media 6. Correspondingly, the projectile body portion 14 can comprise an opaque material colored to match the marking media 6. The matching colors allows for easy sorting of the marking cartridge 2 and identification of the source of a particular impact on a target. In other embodiments, the marking media may be a different color that the base portion polymer. Such color may be a coding indicating a characteristic of the cartridges or projectiles.

The cartridge casing 8 may further comprises a sleeve 36 defining an interior space 38, a telescoping slide 42 and a propellant charge 10. The interior space 38 is divided into a projectile portion 44 and a slide portion 46 by a reduced diameter portion defining a flash hole 48 allowing fluid communication between the projectile portion 44 and the slide portion 46. The telescoping slide 42 comprises a hollow elongated body 50 and a rim 52 for engaging the loading and ejection mechanisms of a firearm. The primer with the propellant charge 10 comprises a quantity of propellant ignitable by the firing pin of a firearm and sized to launch the marking projectile 4 toward the target at a non-lethal velocity.

Figure 5:
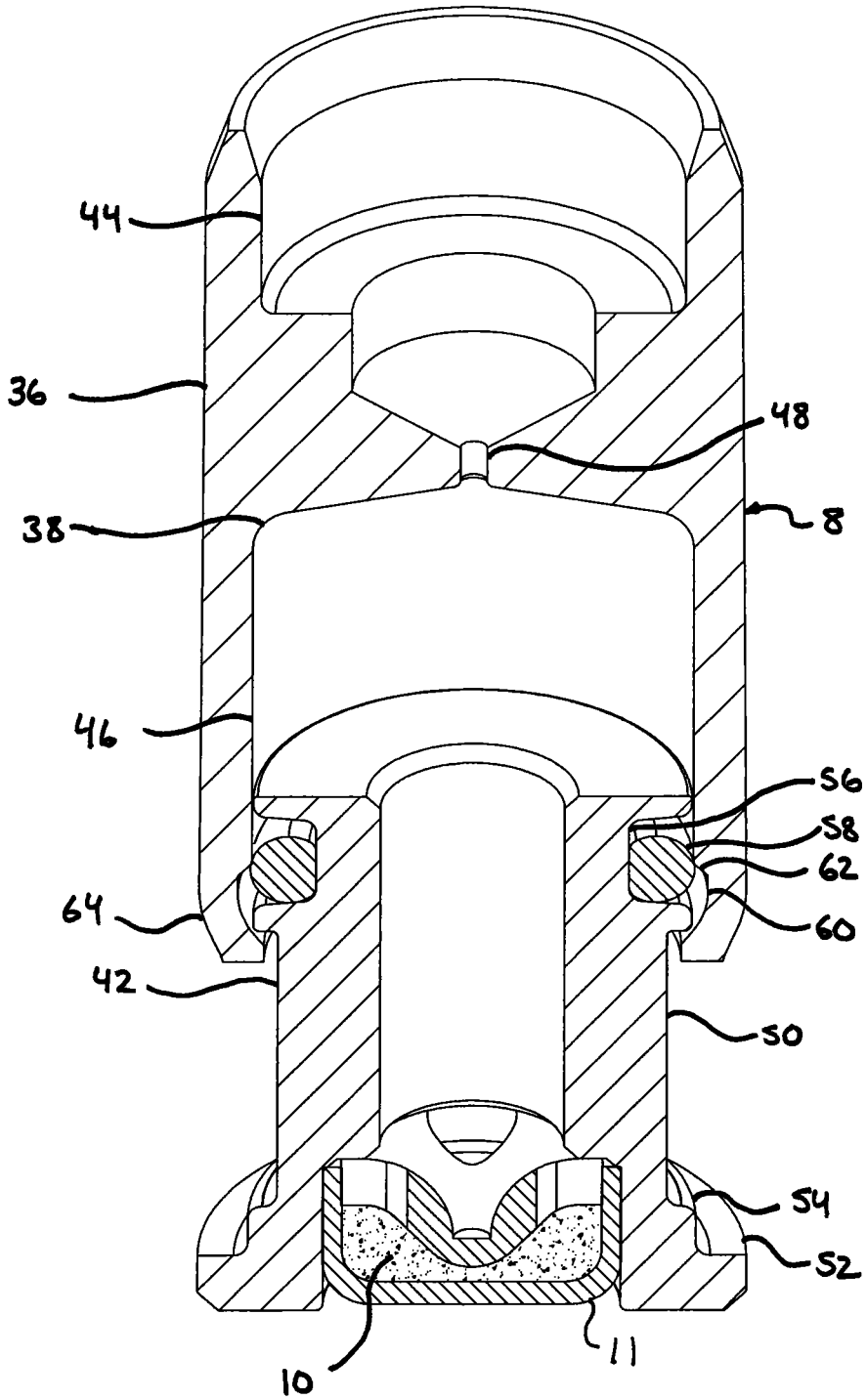
FIG. 5 is a cross-sectional perspective view of the cartridge casing depicted in FIG. 4.

As shown in FIGS. 3, 5 and 7, the marking projectile 4 is seated on the cartridge casing 8 by inserting the marking projectile 4 into the projectile portion 44 of the interior space 38. The propellant charge 10 is placed at the rear of the telescoping slide 42 such that igniting the propellant charge 10 will cause the created gases to travel through the elongated body 50 and the flash hole 48 into the projectile portion 44 to launch the marking projectile 4. The excess gases created by the propellant charge 10 then cause the telescoping portion 42 to extend out of the sleeve 36 simulating the blowback that ordinarily occurs with conventional cartridges. The telescoping slide 42 extends until the rim 52 engages the ejection mechanism of the firearm triggering the ejection of the spent cartridge casing 8.

According to an embodiment of the present invention, the telescoping slide 42 can further comprise a shoulder 54 disposed around rim 52 for engaging the sleeve 36 when the telescoping slide 42 is retracted within the sleeve 36. The shoulder 54 creates a gap between the rim 52 and the sleeve 36 allowing the cartridge casing 8 to be engaged and loaded by the loading mechanism of the firearm.

According to an embodiment of the present invention, the elongated body 50 of the telescoping slide 42 can define a groove 56 for receiving a gasket 58. The gasket 58 is adapted to sealingly engage the interior of the sleeve 36 such that all the gases generated by the propellant charge 10 are either used to propel the marking projectile 4 or "blow back" the telescoping slide 42 to eject the spent cartridge.

According to an embodiment of the present invention, the sleeve 36 can further comprise a reduced thickness portion 60 opposite the projectile portion 44 of the interior space 38 and defining a groove 62 in the interior of the sleeve 36. Similarly, the sleeve 36 can crimped inwardly at the reduced thickness portion 60 to define a crimped portion 67. The crimped portion 64 may be crimped at an angle non-perpendicular to the remainder of the sleeve 36 such that the crimped portion 64 engages the telescoping slide 42 to prevent the telescoping slide 42 from separating from the sleeve 36 as the telescoping slide 42 is blown back by the propellant gases.

Figure 11A:
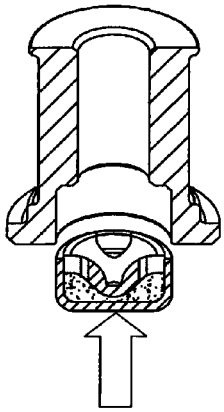
FIGS. 11A-11K illustrate exemplary manufacturing steps according to an embodiment of the invention.
Figure 11B:
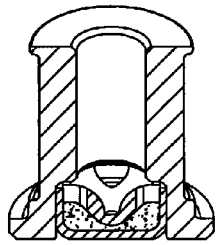
Figure 11C:
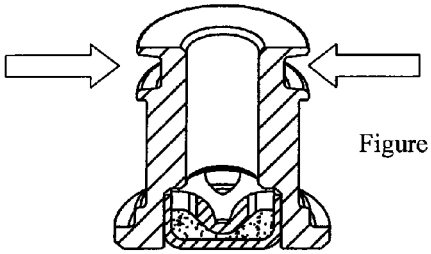
Figure 11D:
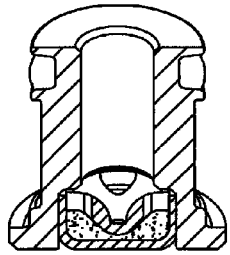
Figure 11E:
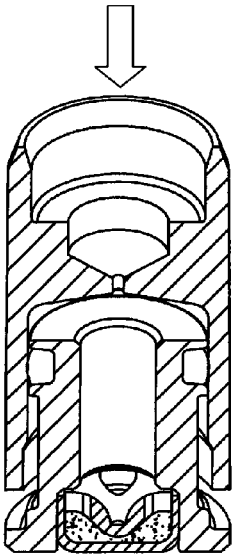
Figure 11F:
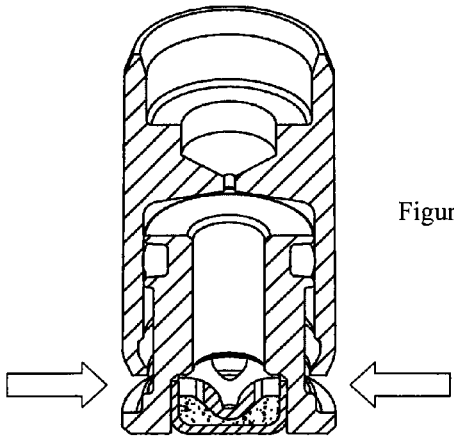
Figure 11G:
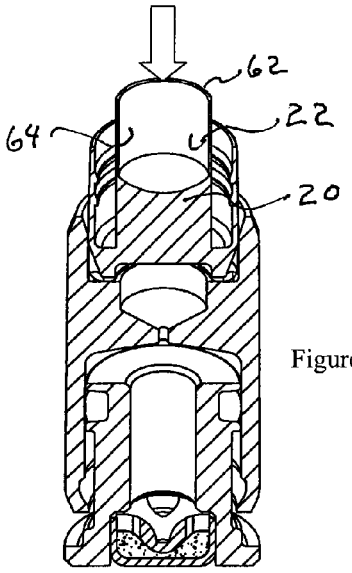
Figure 11H:
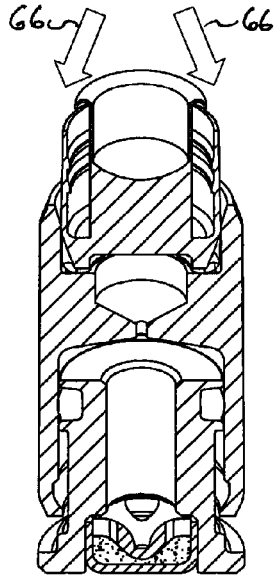
Figure 11I:
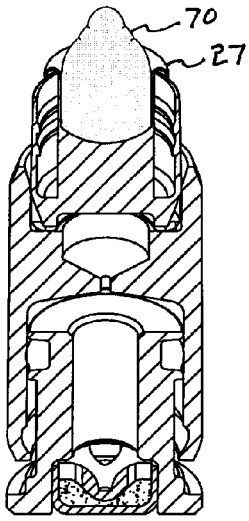
Figure 11J:
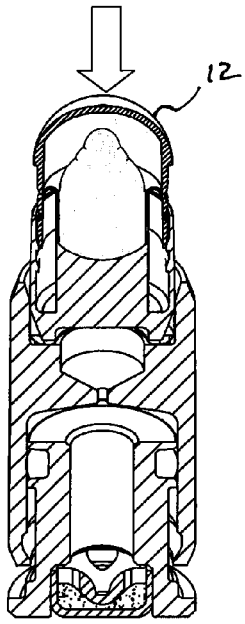
Figure 11K:
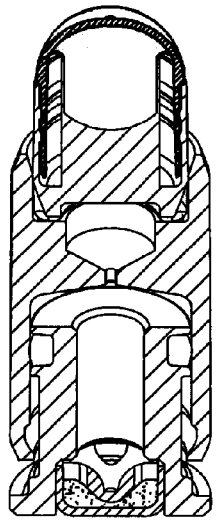

As shown in FIGS. 11A-11K, a marking cartridge 2 is assembled by first providing the telescoping slide 42 and inserting the primer 11 with the propellant charge 10, into the bottom of the telescoping slide 42, FIG. 11A-11B. The o-ring 58 may then be fitted over the elongated body 50 of the telescoping slide 42 and seated within the groove 56, see FIG. 11C-11D. The sleeve 36 is fitted over the elongated body 50 of the telescoping slide 42 and is crimped to form the crimped portion 62 and secure the telescoping slide 42 within the sleeve 36, see FIG. 11E-11F. The projectile body portion 14 is then fitted within the projectile portion 44 of the interior space 38 defined by the sleeve 36, see FIG. 11G. The curled lip 27 is then formed by deformingly rolling over the edge portion 62 of the cylindrical wall 64 edges of the receptacle 22 defined by the inner post 20 of the projectile body portion 14, see FIG. 11G and the arrows 66 on FIG. 11H. A quantity of marking media 6 in the form of a paste or gel is then deposited within the receptacle 22 such that a portion 70 of the marking media 6 protrudes from the receptacle 22. The media has a self supporting form with a tapered and or rounded top portion, see FIG. 11I. Finally, the frangible cap portion 12, with the ogive portion and the cylindrical wall, may be fitted over the inner post 20, where the curled lip may slidingly engage the inside surface of the cylindrical wall, see FIG. 11J. As the cap portion and base portion are urged together, the cylindrical wall of the frangible cap portion may cooperatively and slidingly engage the conforming cylindrical wall of the base portion defining the first cavity. As the cap portion and body portion approach the final seated position, the inside surface of the ogive portion of the cap portion may engage and conform the portion of the marking media 6 that protrudes from the receptacle into the shape of the inside surface of the ogive portion, specifically at the ogive portion of the cap portion. Moreover, also as the cap portion and body portion approach the final seated position, air adjacent to the protruding portion of the marking media may be advantageously forced out of the first cavity at the moving seal formed by the curled lip and inside surface of the cylindrical wall portion of the cap portion as the first cavity is being reduced in size. Moreover, any excess marking media 6 beyond the volumetric size of the first cavity, as the cap portion and body portion are seated, may be squeezed into the second cavity 26 defined around the inner post 20. At the final seated position, see FIG. 11K, the cooperating latch portions engage and lock creating the secondary seal between the wall portion of the base portion and the wall portion of the cap portion and securing the two portions together.

According to an embodiment of the present invention, a groove 56 may be formed in the elongated body 50 the telescoping slide 42 before the sleeve 36 is fitted over the elongated body 50. The sleeve 36 can then be fitted over the elongated body 50 to finish assembly of the cartridge casing 8.

The projectile components may be formed by injection molding. The projectile components may be formed of polymers or other materials. The casing components may be formed of aluminum, brass, or other metals. The primer is conventionally formed.

In embodiments of the invention, certain components herein, and functionalities are similar to the components and functionality of U.S. Pat. No. 7,728,358 and U.S. Publication No.'s 2010/0236442 A1 and US 2010/0269724 A1. All owned by the owner of this application. The disclosures of said patent and publications are incorporated herein by reference.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative embodiments.

What is claimed:

1. A marking cartridge comprising a marking projectile, the marking projectile comprising two polymer components secured together, the marking projectile having a projectile tip portion and a heel portion, the two polymer components defining a first radially centered cavity and a second cavity positioned radially outward from the first cavity, the first cavity at least substantially filled with marking media and extending to a wall that defines the projectile tip portion the second cavity having an annular shape and at least substantially vacated of marking media.

2. The marking cartridge of claim 1 wherein the two polymer components comprise a cap portion and a body portion, the cap portion having an ogive portion with the projectile tip portion and a unitary skirt portion extending downwardly from the ogive portion.

3. The marking cartridge of claim 2 wherein the body portion comprises a base portion, a cylindrical wall unitary with and extending from the base portion, and wherein the skirt portion and cylindrical wall are sized to cooperatively connect with one another.

4. The marking cartridge of claim 3 wherein the skirt portion and cylindrical wall are configured to be slidingly engaged into a snap-fit attachment with the skirt portion and cylindrical wall having tapered lead-in surfaces.

5. The marking cartridge of claim 4 wherein the base portion has a axially extending and centrally located post portion having an cylindrical wall portion with a distal lip, the lip engaged with an inside surface of the ogive portion.

6. The marking cartridge of claim 2 wherein the base portion is of a first polymer, the cap portion is of a second polymer, the second polymer being polystyrene.

7. The marking cartridge of claim 2 wherein the base portion is of a first polymer, the cap portion is of a second polymer, the second polymer having a greater frangibility that the first polymer.

8. The marking projectile of claim 1 wherein marking media in the first cavity is mushroom shaped and said mushroom shape of the marking media is shaped by the wall defining the projectile tip portion.

9. A marking projectile, the projectile having an axis and comprising an ogive portion with an ogive wall portion, a bearing portion with a cylindrical bearing wall portion extending from the ogive, and a heel portion, opposite the ogive portion, connecting to the bearing portion, the ogive wall portion formed of a polymer frangible on impact with a target, the projectile further having a receptacle portion defining a first cavity coextensive with the axis of the projectile and centrally positioned within the ogive portion at the ogive wall portion, wherein the receptacle portion is unitary with the heel portion and further comprises an annular lip that has one of a) an outward flare and b) an outward and heelward flare, and wherein the receptacle portion is radially spaced inward from the bearing wall portion.

10. The marking projectile of claim 9 wherein the receptacle portion radially spaced from the bearing wall portion and the bearing wall portion define a second cavity, the second cavity configured as a cylindrical annulus positioned adjacent the bearing wall portion and extending axially.

11. The marking projectile of claim 10 wherein the first cavity is at least substantially filled with marking media and the second cavity is at least substantially not filled with marking media.

12. The marking projectile of claim 9 wherein the bearing wall is comprised of a first cylindrical wall portion unitary with the ogive wall portion and wherein the heel portion has a second cylindrical wall portion conforming to and engaged with the first cylindrical wall portion and unitary with the heel portion.

13. The marking projectile of claim 12 wherein the bearing wall portion has an axial length and the first cylindrical wall portion and the second cylindrical wall portion each individually extend axially a distance more than half the axial length of the bearing wall portion.

14. The marking projectile of claim 12 wherein the bearing wall portion has an axial length and the first cylindrical wall portion and the second cylindrical wall portion each overlap one another a distance that is most of the axial length of the bearing portion.

15. A method of manufacturing a marking projectile, the marking projectile having an axis, the method comprising:

providing a base portion with a heel portion, an outer wall, and a central receptacle extending axially upward, the receptacle having an annular lip and being displaced radially inward from the outer wall;

placing in the receptacle one of a marking media paste and marking media gel such that the one of the marking media paste and marking media gel fills the receptacle and extends upwardly beyond the annular lip in a self supporting form;

providing a cap portion having a dome or ogive shaped projectile tip and a rearwardly extending wall; joining the cap portion to the base portion such that the self supporting form is depressed and deformed by an inside surface of the dome or ogive shaped projectile tip and the wall of the base portion is connected to the wall of the cap portion at an annular cavity extending around the receptacle, the annular cavity at least substantially devoid of the one of the marking media paste and marking media gel.

16. The method of claim 15, further comprising forming the self supporting form extending above the annular lip of the receptacle to be at least one of rounded and tapering.

17. The method of claim 15 further comprising providing a receptacle and cap portion wherein the diameter of the receptacle is less that the diameter of the dome shaped projectile tip, the diameter of each taken in a plane normal to the axis of the projectile.

18. The method of claim 15 further comprising depressing the self supporting form into a mushroom shaped cavity such that the marking media has a mushroom shape after it has been depressed.

19. Marking cartridge for depositing marking media upon impact with a target, the cartridge comprising:

a marking projectile for conveying a quantity of marking media to a target and depositing the quantity of marking media on the target upon impact, the marking projectile comprising:

a frangible cap portion having a projectile tip portion adapted to fracture on impact with a target and a skirt portion extending from the projectile tip portion;

a projectile body portion comprising a base portion and an inner post including a receptacle for receiving marking media, wherein the base portion further comprises a heel portion from with which the inner post is unitary with and extends therefrom, the receptacle having an annular lip, the projectile body portion attachable to cap portion such that when attached the inner post is inserted into the frangible cap portion, the annular lip engages the frangible cap portion to define a primary enclosed space within the projectile tip portion and the skirt portion engages the projectile body portion to form a secondary enclosed space defined between the post and the skirt; and a quantity of marking media disposed in the receptacle.

20. The marking cartridge of claim 19, wherein the receptacle further comprises a curled lip for engaging the projectile tip portion such that any excess marking media or air trapped in the quantity of marking media deposited in the receptacle are forced out of the primary enclosed space into the secondary enclosed space with the inner post is inserted into the frangible cap portion.

21. The marking cartridge of claim 19, wherein the frangible cap portion comprises a rigid polymer adapted to fracture upon impact with the target and the projectile body portion comprises a durable polymer for preventing fracturing of the rigid polymer until impact with the target.

22. The marking cartridge of claim 19, wherein the projectile body portion further comprises a skirt portion corresponding to the skirt portion of the projectile cap portion such that the skirt portion of the projectile body portion extends over the skirt portion of the frangible cap portion when the inner post is inserted into the frangible cap portion, wherein only the projectile tip portion protrudes from the projectile body portion after the projectile body portion and frangible cap portion are fitted together.

23. The marking cartridge of claim 22, wherein the skirt portion of the projectile body portion can be sealingly engaged to the skirt portion of the projectile cap portion to provide a hermetically sealed primary and secondary enclosed spaces.

24. The marking cartridge of claim 22, wherein the skirt portion of the projectile body defines a cylindrical bearing portion that is engagable by the rifling of a firearm to impart a spin to the marking projectile during firing.

* * * * *

UNITED STATES PATENT AND TRADEMARK OFFICE

CERTIFICATE OF CORRECTION

PATENT NO. : 8,485,102 B2
APPLICATION NO. : 13/087187
DATED : July 16, 2013
INVENTOR(S) : Erik K. Carlson, Lawrence P. Head and Matthew Schroeder It is certified that error appears in the above-identified patent and that said Letters Patent is hereby corrected as shown below:

In the Specification
Column 2, Line 9, delete “insure” and insert --ensure--, therefor In the Claims
Column 12, Claim 1, Line 53, after “portion” insert --,--, therefor
Column 13, Claim 7, Line 12, delete “that” and insert --than--, therefor
Column 14, Claim 15, Line 2, after “wall;” insert --¶--, therefor
Column 14, Claim 17, Line 16, delete “that” and insert --than--, therefor Signed and Sealed this
Tenth Day of February, 2015

Michelle K. Lee

Michelle K. Lee
*Deputy Director of the United States Patent and Trademark Office*